US008942581B2

(12) United States Patent
Tamura

(10) Patent No.: US 8,942,581 B2
(45) Date of Patent: Jan. 27, 2015

(54) IMAGE FORMING APPARATUS

(71) Applicant: Aya Tamura, Tajimi (JP)

(72) Inventor: Aya Tamura, Tajimi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 139 days.

(21) Appl. No.: 13/623,396

(22) Filed: Sep. 20, 2012

(65) Prior Publication Data

US 2013/0108289 A1 May 2, 2013

(30) Foreign Application Priority Data

Oct. 31, 2011 (JP) ..... 2011-238976

(51) Int. Cl.

| | |
|---|---|
| ***G03G 15/00*** | (2006.01) |
| ***G03G 15/16*** | (2006.01) |
| ***G03G 21/00*** | (2006.01) |
| ***G03G 15/01*** | (2006.01) |

(52) U.S. Cl.

CPC .... *G03G 15/0194* (2013.01); *G03G 2215/0141* (2013.01); *G03G 21/0058* (2013.01); *G03G 15/168* (2013.01); *G03G 15/161* (2013.01)

USPC ..... 399/43; 399/101; 399/44; 399/71

(58) Field of Classification Search

CPC . G03G 21/00; G03G 15/168; G03G 21/0076; G03G 2215/1647; G03G 2215/1652; G03G 2215/1657; G03G 2215/1661; G03G 2221/001; G03G 2221/1815; G03G 21/0058; G03G 15/161; G03G 2215/0141

USPC ..... 399/66, 71, 101, 360, 123, 358

See application file for complete search history.

(56) References Cited

U.S. PATENT DOCUMENTS

| | | | | |
|---|---|---|---|---|
| 7,539,432 | B2 | 5/2009 | Dan | |
| 7,995,960 | B2 * | 8/2011 | Kamimura | 399/357 |
| 2007/0048010 | A1 * | 3/2007 | Nakano | 399/121 |
| 2008/0031649 | A1 | 2/2008 | Dan | |
| 2008/0069590 | A1 * | 3/2008 | Shigehiro | 399/149 |
| 2009/0142116 | A1 * | 6/2009 | Sato et al. | 399/360 |
| 2014/0037326 | A1 * | 2/2014 | Hashimoto | 399/103 |

FOREIGN PATENT DOCUMENTS

| | | |
|---|---|---|
| JP | 08-006403 A | 1/1996 |
| JP | 08-123274 A | 5/1996 |

(Continued)

OTHER PUBLICATIONS

Machine translation of Ota, JP 2006-119279 (2014).*

*Primary Examiner* — David Gray
*Assistant Examiner* — Sevan A Aydin
(74) *Attorney, Agent, or Firm* — Banner & Witcoff, Ltd.

(57) ABSTRACT

An image forming apparatus is configured to perform a collecting operation for moving the attached matter held on a holding roller onto the photosensitive drum and collecting the attached matter by a collecting unit. A bias control unit for controlling a bias applied to the holding roller is configured to: during an image forming operation, apply a first bias for moving the matter onto the holding roller; and during the collecting operation, apply a second bias for moving the attached matter onto the photosensitive drum. A speed control unit is configured to: control the holding roller to rotate at a first rotating speed during the image forming operation; and in a progress of the collecting operation, control the holding roller to rotate at a second rotating speed for a first period after the bias control unit applies the second bias to the holding roller.

19 Claims, 10 Drawing Sheets

(56) References Cited

FOREIGN PATENT DOCUMENTS

| | | | | |
|---|---|---|---|---|
| JP | 2003-280334 | A | | 10/2003 |
| JP | 2006119279 | A | * | 5/2006 |
| JP | 2008-039905 | A | | 2/2008 |

* cited by examiner

IMAGE FORMING APPARATUS

CROSS-REFERENCE TO RELATED APPLICATIONS

This application claims priority from Japanese Patent Application No. 2011-238976 filed on Oct. 31, 2011, the entire subject matter of which is incorporated herein by reference.

TECHNICAL FIELD

The present invention relates to an image forming apparatus including a roller for temporarily holding matter attached on a surface of a photosensitive drum, an endless belt, or the like.

BACKGROUND

There have been known an image forming apparatus having a roller such as a cleaning roller for temporarily holding attached matter such as residual toner attached on a surface of a photosensitive drum. For example, the related-art image forming apparatus is configured to temporarily collect attached matter by the cleaning roller during image forming and reattach the attached matter onto the photosensitive drum after the image forming terminates, so as to collect the attached matter through the photosensitive drum and a conveyance belt.

In this process, a bias is applied to the cleaning roller such that: in a case of collecting the attached matter, the attached matter moves from the photosensitive drums to the cleaning rollers; and in a case of reattaching the attached matter, the attached matter moves from the cleaning rollers to the photosensitive drums.

SUMMARY

Illustrative aspects of the present invention provide an image forming apparatus capable of suppressing scattering of attached matter.

According to one illustrative aspect of the present invention, there is provided an image forming apparatus comprising: an image carrier; a holding roller configured to hold matter attached on a surface of the image carrier; a collecting unit; and a control device configured to perform: a bias control process of controlling a bias to be applied to the holding roller; a speed control process of controlling a rotating speed of the holding roller; and an operation control process of controlling the image forming apparatus to perform: an image forming operation for forming an image on a recording sheet; and a collecting operation for moving the attached matter held on the holding roller onto the image carrier and collecting the attached matter through the image carrier by the collecting unit. The bias control process comprises: during the image forming operation, applying a first bias for moving the matter attached on the surface of the image carrier onto the holding roller; and during the collecting operation, applying a second bias for moving the attached matter held on the holding roller onto the image carrier. The speed control process comprises: controlling the holding roller to rotate at a first rotating speed during the image forming operation; and in a progress of the collecting operation, controlling the holding roller to rotate at a second rotating speed, which is slower than the first rotating speed, at least for a first period after the bias control unit applies the second bias to the holding roller.

DETAILED DESCRIPTION

<General Overview>

Figure 1:
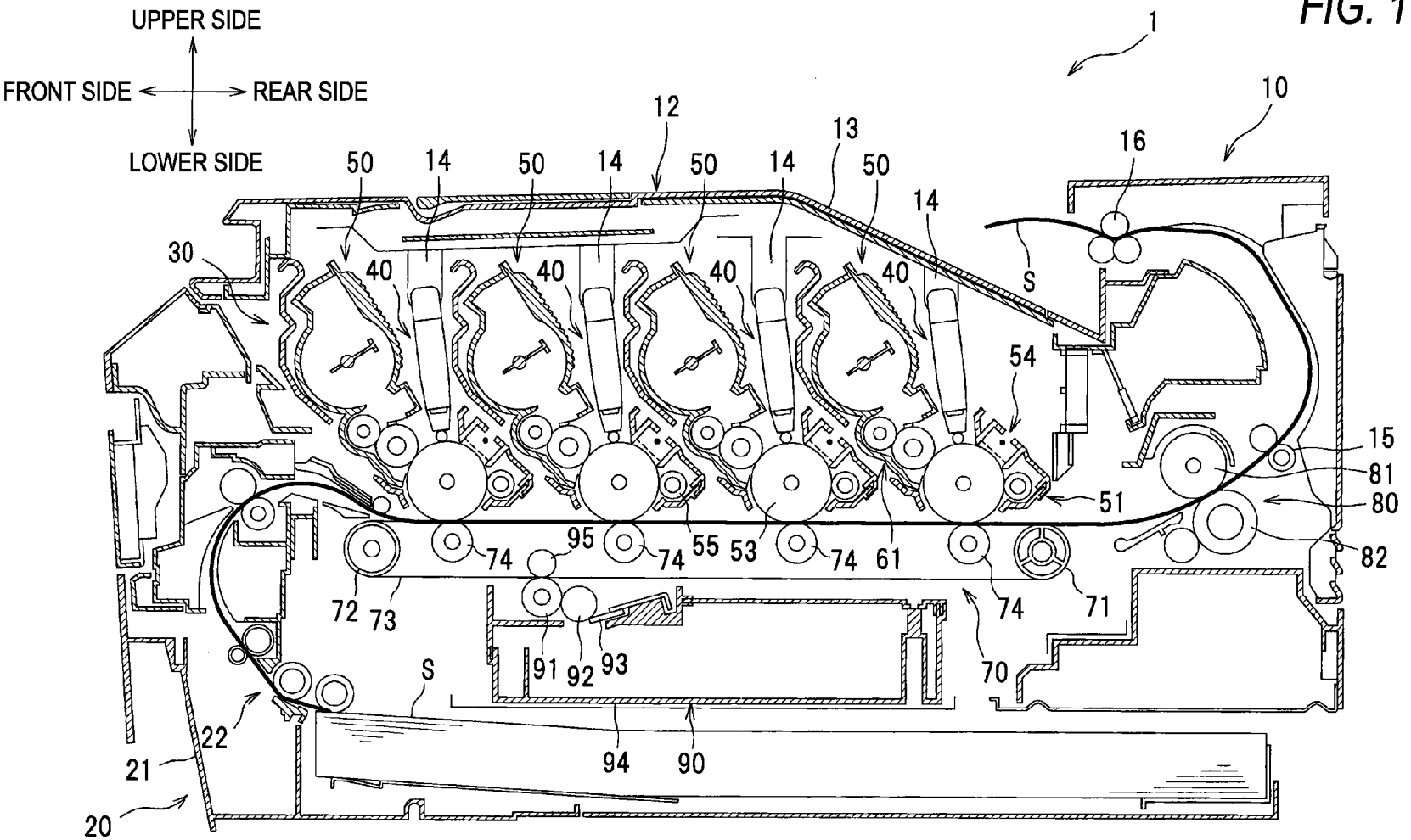
FIG. 1 is a view illustrating a schematic configuration of a color printer according to an exemplary embodiment.

However, in the above-described related-art image forming apparatus, in a case of changing the bias to be applied to the cleaning rollers from a bias for collecting the attached matter onto the cleaning rollers to a bias for reattaching the attached matter onto the photosensitive drums, since a power of the cleaning roller to hold the attached matter is reduced, the attached matter may be scattered around the cleaning roller with rotation of the cleaning roller. The scattered attached matter may be attached to a wall, a charger, and the like around the cleaning roller, and then be attached onto a sheet or the like from the wall, the charger, and the like, so that image quality may be reduced and/or an inside of the image forming apparatus may become dirty.

Therefore, illustrative aspects of the present invention provide an image forming apparatus capable of suppressing scattering of attached matter.

According to one illustrative aspect of the present invention, there is provided an image forming apparatus comprising: a photosensitive drum; a holding roller configured to hold matter attached on a surface of the photosensitive drum; a bias control unit configured to control a bias to be applied to the holding roller; and a speed control unit configured to control a rotating speed of the holding roller. The image forming apparatus is configured to perform: an image forming operation for forming an image on a recording sheet; and a collecting operation for moving the attached matter held on the holding roller onto the photosensitive drum and collecting the attached matter through the photosensitive drum by a collecting unit. The bias control unit is configured to: during the image forming operation, apply a first bias for moving the matter attached on the surface of the photosensitive drum onto the holding roller; and during the collecting operation, apply a second bias for moving the attached matter held on the holding roller onto the photosensitive drum. The speed control unit is configured to: control the holding roller to rotate at a first rotating speed during the image forming operation; and in a progress of the collecting operation, control the holding roller to rotate at a second rotating speed, which is slower than the first rotating speed, at least for a first period after the bias control unit applies the second bias to the holding roller.

According to another illustrative aspect of the present invention, there is provided an image forming apparatus comprising: a photosensitive drum; an endless belt that is disposed to face the photosensitive drum; a holding roller configured to hold matter attached on a surface of the belt; a bias control unit configured to control a bias to be applied to the holding roller; and a speed control unit configured to control a rotating speed of the holding roller. The image forming apparatus is configured to perform: an image forming operation for forming an image on a recording sheet; and a collecting operation for moving the attached matter held on the holding roller onto the belt and collecting the attached matter through the belt by a collecting unit. The bias control unit is configured to: during the image forming operation, apply a first bias for moving the matter attached on the surface of the belt onto the holding roller; and during the collecting operation, apply a second bias for moving the attached matter held on the holding roller onto the belt. The speed control unit is configured to: control the holding roller to rotate at a first rotating speed during the image forming operation; and in the progress of the collecting operation, control the holding roller to rotate at a second rotating speed, which is slower than the first rotating speed, at least for a first period after the bias control unit applies the second bias to the holding roller.

According to the above configurations, while the second bias is applied such that the power of the holding roller to hold the attached matter is reduced, the holding roller is rotated at a low rotating speed, whereby it is possible to reduce a centrifugal force acting on the attached matter. Therefore, it is possible to suppress the scattering of the attached matter around the holding roller, and thus it becomes possible to suppress a reduction in the image quality and pollution of the inside of the image forming apparatus.

According to still another illustrative aspect of the present invention, the bias control unit is configured to apply the second bias after the speed control unit changes the rotating speed of the holding roller from the first rotating speed to the second rotating speed.

According to this configuration, after reducing the centrifugal force acting the attached matter, it is possible to reduce the power of the hold roller to hold the attached matter. Therefore, it is possible to further suppress the scattering of the attached matter.

According to still another illustrative aspect of the present invention, a timing when the bias control unit starts control for applying the second bias to the holding roller is the same as a timing when the speed control unit starts control for rotating the holding roller at the second rotating speed.

According to this configuration, it is possible to suppress the scattering of the attached matter, and to reduce the time required for the collecting operation, as compared to a case where the timing when the control for applying the second bias starts and the timing when the control for rotating the holding roller at the second rotating speed starts are deviated from each other. Therefore, it is possible to reduce time for the next image forming operation to become possible.

According to still another illustrative aspect of the present invention, the bias control unit is configured to gradually change a value of the bias when changing the bias to be applied to the holding roller from the first bias to the second bias.

According to this configuration, it is possible to gradually reduce the power of the hold roller to hold the attached matter, and thus it is possible to more certainly suppress the scattering of the attached matter.

According to still another illustrative aspect of the present invention, the image forming apparatus is configured to input a torque from the photosensitive drum to the holding roller.

The holding roller capable of holding matter attached on the photosensitive drum is disposed close to the photosensitive drum. Therefore, by configuring the holding roller to be subjected to torque input from the photosensitive drum, the configuration for rotating the holding roller can be simplified.

According to still another illustrative aspect of the present invention, in the progress of the collecting operation, the speed control unit is configured to control the holding roller to rotate at the second speed for a second period from when the collecting operation starts, and thereafter, control the holding roller to rotate at the first rotating speed.

It is considered that in an early stage of the collecting operation, more matter are attached to the holding roller and are likely to be scattered. For this reason, at that time, by rotating the holding roller at a low rotating speed, it is possible to effectively suppress the scattering of the attached matter. Also, after the second period elapses, that is, in a stage in which it is considered that the amount of attached matter on the holding roller is less and the attached matter are unlike to be scattered, by rotating the holding roller at a high rotating speed, it is possible to reduce time required for the collecting operation wile suppressing the scattering of the attached matter.

According to still another illustrative aspect of the present invention, the image forming apparatus further comprises: a counting unit configured to count a number of recording sheets subjected to the image forming operation. The image forming apparatus is configured to perform the collecting operation in a case where a count value of the counting unit exceeds a first threshold value.

According to this configuration, it is possible to reduce the time required to terminate image forming, specifically, when images are consecutively formed on a plurality of recording sheets, as compared to a case of performing the collecting operation whenever image forming onto each recording sheet terminates.

According to still another illustrative aspect of the present invention, the image forming apparatus further comprises: a humidity detecting unit configured to detect humidity in the image forming apparatus. In a case where a detection value of the humidity detecting unit is equal to or lower than predetermined humidity, the image forming apparatus is configured to perform the collecting operation when the count value of the counting unit exceeds a second threshold value that is smaller than the first threshold value.

Specifically, in a case where the recording sheet is paper, at low humidity, since the resistance value of the recording sheet is large, it is likely that more attached matter remains on the photosensitive drum, more attached matter is held on the holding roller in a short time. For this reason, when the humidity is low, by performing the collecting operation at an early stage, it is possible to effectively suppress the scattering of the attached matter.

According to still another illustrative aspect of the present invention, the image forming apparatus further comprises: an endless belt that is disposed to face the photosensitive drum; and a belt cleaning unit configured to function as the collecting unit for collecting matter attached on the surface of the belt. In the collecting operation, the belt cleaning unit is configured to collect the attached matter held on the holding roller through the photosensitive drum and the belt.

According to still another illustrative aspect of the present invention, the collecting unit comprises a blade configured to come into slide contact with the photosensitive drum and to collect the matter attached on the surface of the photosensitive drum.

According to the illustrative aspects of the present invention, while the second bias is applied such that the attached matter held on the holding roller moves onto the photosensitive drum, the holding roller is rotated at the low second rotating speed. Therefore, it is possible to suppress the scattering of the attached matter around the holding roller.

EXEMPLARY EMBODIMENTS

First Exemplary Embodiment

Now, a first exemplary embodiment of the present invention will be described in detail with reference to appropriate drawings. Hereinafter, a schematic configuration of a color printer 1 (one example of an image forming apparatus) of the exemplary embodiment will be first described in brief, and then configurations and control relative to characterizing portions of the present invention will be described in detail.

In the following description, directions of the color printer 1 refer to the directions as seen from a user facing to the color printer during its use. To be more specific, referring to FIG. 1, a left-side direction and a right-side direction of the drawing sheet are referred to as a "front side" and a "rear side" of the color printer, respectively. Also, a direction toward the viewer of FIG. 1 as a "right side", and a direction away from a viewer of FIG. 1 is referred to as a "left side". An upward and downward direction in FIG. 1 is referred to as a "vertical direction".

(Schematic Configuration of Color Printer)

As shown in FIG. 1, the color printer 1 includes a sheet feeding unit 20, an image forming unit 30, and a belt cleaning unit 90 (one example of a collecting unit), which are contained in a main body casing 10 (one example of a main body of the image forming apparatus). On the upper side of the main body casing 10, an upper cover 12 is configured to be upwardly and downwardly rotatable (openable and closable) on its rear side.

The sheet feeding unit 20 is provided at the lower portion in the main body casing 10. The sheet feeding unit 20 includes a sheet feed tray 21 configured to accommodate sheet S (one example of a recording sheet), and a sheet feeding mechanism 22 configured to feed the sheet S from the sheet feed tray 21 to the image forming unit 30. A stack of sheets S stored in the sheet feed tray 21 is fed to the image forming device 30 one at a time by the sheet feeding mechanism 22.

The image forming unit 30 includes four LED units 40, four process units 50, a transfer unit 70, and a fixing unit 80.

The LED units 40 are disposed to face the upper sides of photosensitive drums 53. The LED units 40 include a plurality of LEDs (not shown) arranged in the left/right direction at their lower ends. Light emitting portions of the LED units 40 are turned on or off on the basis of image data so as to irradiate the surfaces of the photosensitive drums 53 with light. Also, the LED units are configured to be held on the upper cover 12 through holding portions 14 such that the LED units 40 are spaced apart from the photosensitive drums 53 when the upper cover 12 is opened.

The process units 50 are configured to be disposed in parallel in the front/rear direction between the upper cover 12 and the sheet feeding unit 20. The process units 50 are detachably mounted to the main body casing 10 in a state where the upper cover 12 is open. The process units 50 include photosensitive units 51, and developing units 61 that are attachable and detachable with respect to the photosensitive units 51.

Figure 2:
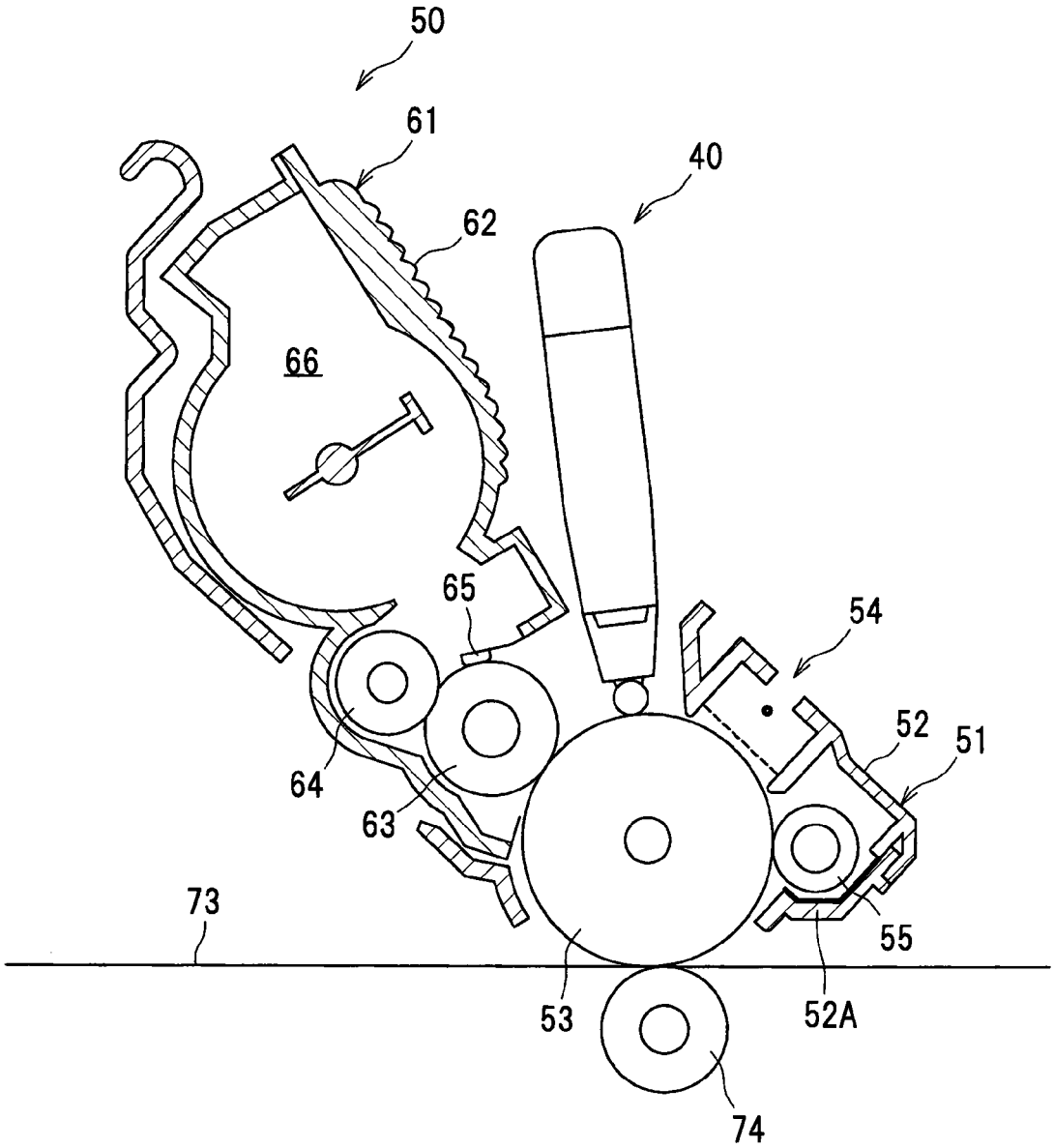
FIG. 2 is an enlarged view illustrating a vicinity of a process unit.

As shown in FIG. 2, each photosensitive unit 51 includes a photosensitive drum 53 (one example of an image carrier), a charger 54, and a holding roller 55, which are contained in a photosensitive frame 52. Also, each developing unit 61 includes a developing roller 63, a feeding roller 64, a layer-thickness regulating blade 65, and a toner containing unit 66 for containing positively charged toner (a developer), which are contained in a developing frame 62.

Referring to FIG. 1 again, the transfer unit 70 is disposed between the sheet feeding unit 20 and the process units 50. The transfer unit 70 includes a drive roller 71, a driven roller 72, a conveyance belt 73 (one example of an endless belt), and four transfer rollers 74. The conveyance belt 73 is stretched tightly between the drive roller 71 and the driven roller 72. The outer surface of the conveyance belt 73 faces the photosensitive drums 53, and the transfer rollers 74 are disposed on the inner side of the conveyance belt 73 such that the conveyance belt 73 is interposed between the photosensitive drums 53 and the transfer rollers 74.

The fixing unit 80 is provided on the rear side relative to the process units 50 and the transfer unit 70. The fixing unit 80 includes a heating roller 81, and a pressing roller 82, which is disposed to face the heating roller 81 and press the heating roller 81.

The belt cleaning unit 90 is disposed below the conveyance belt 73. The belt cleaning unit 90 includes a cleaning roller 91, a collecting roller 92, a scraping blade 93, a toner retaining unit 94, and a backup roller 95 disposed to sandwich the conveyance belt 73 together with the cleaning roller 91.

(Outline of Operation of Color Printer)

The color printer 1 of the present exemplary embodiment is configured to perform an image forming operation of forming images on the sheet S and a collecting operation of making the belt cleaning unit 90 collect toner (one example of attached matter) held on the holding roller 55. Hereinafter, the outline of each operation will be described.

When receiving a print job including an instruction for starting image forming, data on images to be formed, information on the number of images to be formed, and the like from an external apparatus such as a personal computer (not shown), the color printer 1 starts the image forming operation and rotates the photosensitive drums 53, conveyance belt 73, and the like.

Then, the surfaces of the rotating photosensitive drums 53 are uniformly and positively charged by the chargers 54, and are exposed by the LED units 40, whereby electrostatic latent images based on the image data are formed on the photosensitive drums 53. Next, the toner in the toner containing units 66 is fed to the developing rollers 63 through the feed rollers 64, and the toner is carried as thin layers having a uniform thickness on the development rollers 63 between the development rollers 63 and the layer-thickness regulating blades 55.

Then, the toner carried on the development rollers 63 is supplied to the photosensitive drums 53 having the electrostatic latent image formed thereon, such that the electrostatic latent images are visualized, that is, the toner images are formed on the photosensitive drums 53. Also, at an appropriate timing before this visualization, the sheet feeding mechanism 22 feeds a sheet S stored in the sheet feed tray 21 toward the image forming unit 30.

The sheet S fed from the sheet feeding unit 20 is conveyed between the photosensitive drums 53 and the conveyance belt 73 (the transfer rollers 74), whereby the toner images formed on the photosensitive drums 53 are sequentially transferred onto the sheet S such that the toner images overlap one another. Next, the sheet S having the toner image transferred thereon is conveyed between a heating roller 81 and a pressing roller 82, whereby the toner image is thermally fixed.

The sheet S having the toner image thermally fixed thereon, that is, the sheet S having the image formed thereon is discharged from the inside to the outside of the main body casing 10 by a conveyance roller 15 and a discharging roller 16 provided in the main body casing 10. Then, the sheet S is loaded on a discharge tray 13.

When performing the collecting operation, the color printer 1 rotates the photosensitive drums 53, the holding rollers 55, the conveyance belt 73, the cleaning roller 91, and the collecting roller 92. Then, toner held on the holding rollers 55 is first moved onto the photosensitive drums 53, and then is moved from the photosensitive drums 53 to the conveyance belt 73.

Next, the toner attached to the surface of the conveyance belt 73 moves through between the conveyance belt 73 (e.g., the backup roller 95) and the cleaning roller 91 according to the rotation of the conveyance belt 73, thereby being collected by the cleaning roller 91. The toner collected by the cleaning roller 91 is collected by the collecting roller 92, is scrapped off the collecting roller 92 by the scraping blade 93, and is retained in the toner retaining unit 94.

(Detailed Configuration of Color Printer)

Now, configurations and control relating to characterizing portions of the present invention will be described in detail.

Figure 3:
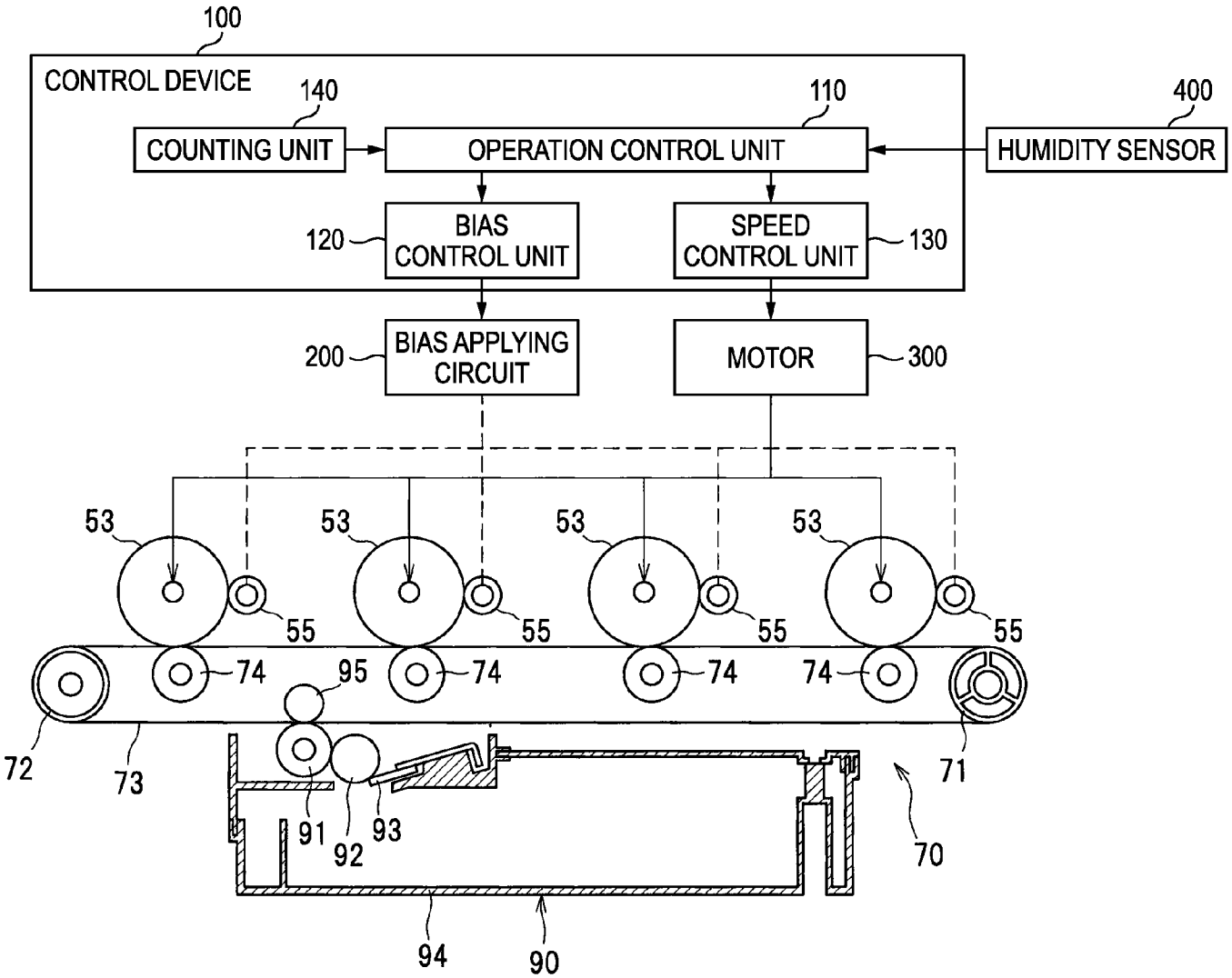
FIG. 3 is a view illustrating a configuration for controlling a bias to be applied to holding rollers and a rotating speed of the holding rollers.

As shown in FIG. 3, the color printer 1 includes the photosensitive drums 53, the holding rollers 55, the transfer unit 70, and the belt cleaning unit 90. In addition, the color printer 1 also includes a control device 100, a bias applying circuit 200, a motor 300, and a humidity sensor 400 (one example of a humidity detecting unit) accommodated in the main body casing 10.

The holding rollers 55 are configured to hold toner (e.g., attached matter) attached on the surfaces of the photosensitive drums 53. The holding rollers 55 include conductive rotary shafts and conductive roller bodies covering the circumferences of the rotary shafts. When a negative bias (e.g., a first bias which has the opposite polarity to the charge polarity of the toner) is applied, the holding rollers 55 attract non-transferred toner on the photosensitive drums 53 and temporarily hold the toner on their surfaces. Then, if a positive bias higher than the surface potentials of facing portions of the photosensitive drums 53 (e.g., a second bias which has the same polarity as the charge polarity of the toner) is applied, the holding rollers 55 release the held toner such that the toner is moved onto the photosensitive drums 53.

The holding rollers 55 are configured to be subjected to torque input from the corresponding photosensitive drums 53. A specific mechanism for the driving force transmission may not be limited. For example, the mechanism for the driving force transmission may be configured such that gears provided at one end portions of the rotary shafts of the holding rollers 55 are engaged with gears provided at one end portions of the photosensitive drums 53, whereby torques are input from the photosensitive drums 53 to the holding rollers 55. Alternatively, for example, the holding rollers 55 may be configured to be driven to rotate by friction with the surfaces of the rotating photosensitive drums 53.

In the present exemplary embodiment, the holding rollers 55 are disposed close to the photosensitive drums 53. Therefore, by configuring the holding rollers 55 to be subjected to torque input from the photosensitive drums 53, it is possible to simplify the mechanism for rotating the holding rollers 55.

The bias applying circuit 200 is for applying a bias (e.g., voltage) to the holding rollers 55. The bias applying circuit 200 is connected to the rotary shafts of the holding rollers 55. The bias applying circuit 200 is configured to change the bias to be applied to the holding rollers 55 by a known configuration.

The motor 300 is a driving source which gives a torque to the photosensitive drums 53, the conveyance belt 73, the cleaning roller 91, and the like. The motor 300 is configured such that the rotating speed of the motor 300 is changeable. In the present exemplary embodiment, the motor 300 rotates the holding rollers 55 through the photosensitive drums 53. Therefore, as will be described below, when the holding rollers 55 rotate at a low speed (e.g., a second rotating speed), the rotating speeds of the photosensitive drums 53 and the like also become slower than those during the image forming operation.

The humidity sensor 400 is for detecting the humidity of the inside of the main body casing 10. The humidity sensor 400 is disposed at an appropriate position in the main body casing 10. The humidity (e.g., detection value) detected by the humidity sensor 400 is output to the control device 100.

The control device 100 controls each unit of the color printer 1 according to a predetermined program or the like, and is configured to include a CPU, a RAM, a ROM, an input/output interface, and the like (not shown). The control device 100 includes an operation control unit 110, a bias control unit 120, a speed control unit 130, and a counting unit 140, as functional units relating to the present invention.

The counting unit 140 is a functional unit for counting the number of sheets S subjected to image forming. Specifically, in the present exemplary embodiment, the counting unit 140 counts the cumulative number of sheets S subjected to image forming, on the basis of information on the number of images which are image forming targets included in a print job input to the control device 100. The counting unit 140 resets a count value (to 0) when the collecting operation starts or when the collecting operation terminates. The count value of the counting unit 140 is output to the operation control unit 110.

The operation control unit 110 is a functional unit for controlling the operation of the color printer 1. Specifically, in the present exemplary embodiment, the operation control unit 110 controls each of the functional units of the control device 100 (e.g., the bias control unit 120 and the speed control unit 130) and each unit of the color printer 1, such that: when a print job is input, the units perform the image forming operation; and when formation of all of images which are image formation targets included in the input print job terminates, the units perform the collecting operation.

In the present exemplary embodiment, even in a case where the count value of the counting unit 140 exceeds a first threshold value (for example, 60), the operation control unit 110 controls each of the functional units of the control device 100 and each unit of the color printer 1, such that the units perform the collecting operation.

Further, in a case where the detection value of the humidity sensor 400, that is, the humidity in the main body casing 10 is equal to or lower than predetermined humidity (for example, 20% RH), when the count value of the counting unit 140 exceeds a second threshold value (for example, 20) smaller than the first threshold value, the operation control unit 110 controls each of the functional units of the control device 100 and each unit of the color printer 1, such that the units perform the collecting operation.

Figure 4:
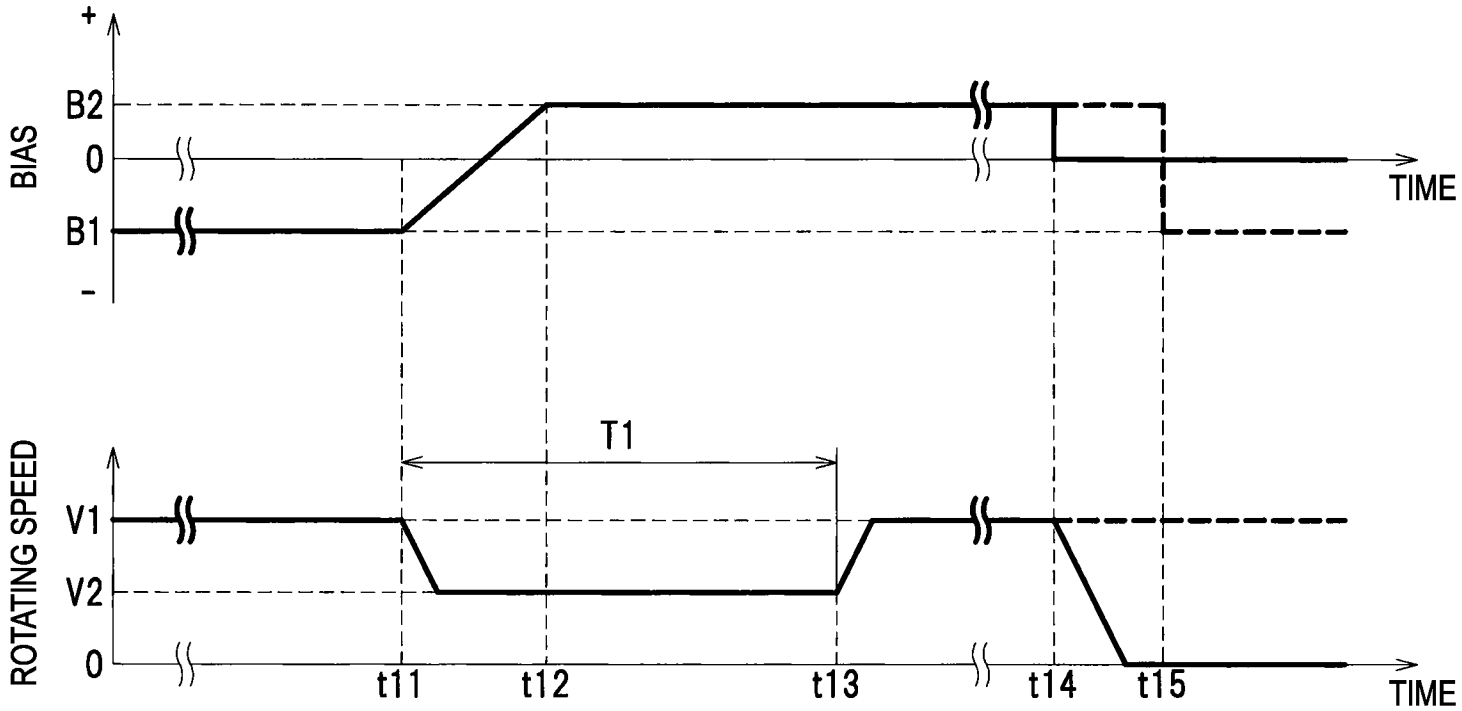
FIG. 4 is a timing chart illustrating the bias to be applied to the holding rollers and the rotating speed of the holding rollers according to a first exemplary embodiment.

The bias control unit 120 is a functional unit for controlling the bias to be applied to the holding rollers 55 when the image forming operation or the collecting operation is performed. More specifically, as shown in FIG. 4, the bias control unit 120 is configured to apply a first bias B1 during the image forming operation (see before a timing t11) such that toner attached on the surfaces of the photosensitive drums 53 moves onto the holding rollers 55, and to apply a second bias B2 during the collecting operation (see from the timing t11 to a timing t14) such that the toner held on the holding rollers 55 moves onto the photosensitive drums 53.

In the present exemplary embodiment, the bias control unit 120 is configured to gradually (e.g., linearly) change the value of the bias when changing the bias to be applied to the holding rollers 55 from the first bias B1 to the second bias B2 (see the timing t11 to a timing t12). Further, in the present exemplary embodiment, the bias control unit 120 is configured to rapidly change the bias value when changing the bias to be applied to the holding rollers 55 from the second bias B2 to the first bias B1 (see a timing t15).

The speed control unit 130 (see FIG. 3) is a functional unit for controlling the rotating speed of the holding rollers 55 when the image forming operation or the collecting operation is performed. More specifically, the speed control unit 130 controls the holding rollers 55 such that in the progress of the collecting operation, after the bias control unit 120 starts control for applying the second bias B2 to the holding rollers 55 (see the timing t11), at least for a first period T1, the holding rollers 55 rotate at a second rotating speed V2 (which may be ½ of a first rotating speed V1 during the image forming operation, for instance) slower than the first rotating speed V1.

Here, the first period T1 is appropriately set according to the diameter and rotating speed of the holding rollers 55 such that the holding rollers 55 rotate a predetermined number of times for the first period T1. In the present exemplary embodiment, the first period T1 is set to a period for which the holding rollers 55 rotate one or two times.

Also, in the progress of the collecting operation, after the collecting operation starts (see the timing t11), for the first period T1 (one example of a second period), the speed control unit 130 rotates the holding rollers 55 at the second rotating speed V2. Thereafter (see a timing t13), the speed control unit 130 starts control for rotating the holding rollers 55 at the first rotating speed V1, such that the holding rollers 55 rotates at the first rotating speed V1.

Incidentally, as shown in FIG. 4, a time lag occurs from the timing when the control for rotating the holding rollers 55 at the first (or second) rotating speed starts to when the holding rollers 55 starts to actually rotate at the first (or second) rotating speed.

In the present exemplary embodiment (see the timing t11), the timing when the bias control unit 120 starts the control for applying the second bias B2 to the holding rollers 55 is set to be the same as the timing when the speed control unit 130 starts the control for rotating the holding rollers 55 at the second rotating speed V2.

(Operation and Advantage of Color Printer)

Now, the operation and effect of the color printer 1 will be described with reference to FIGS. 4 and 5.

Figure 5:
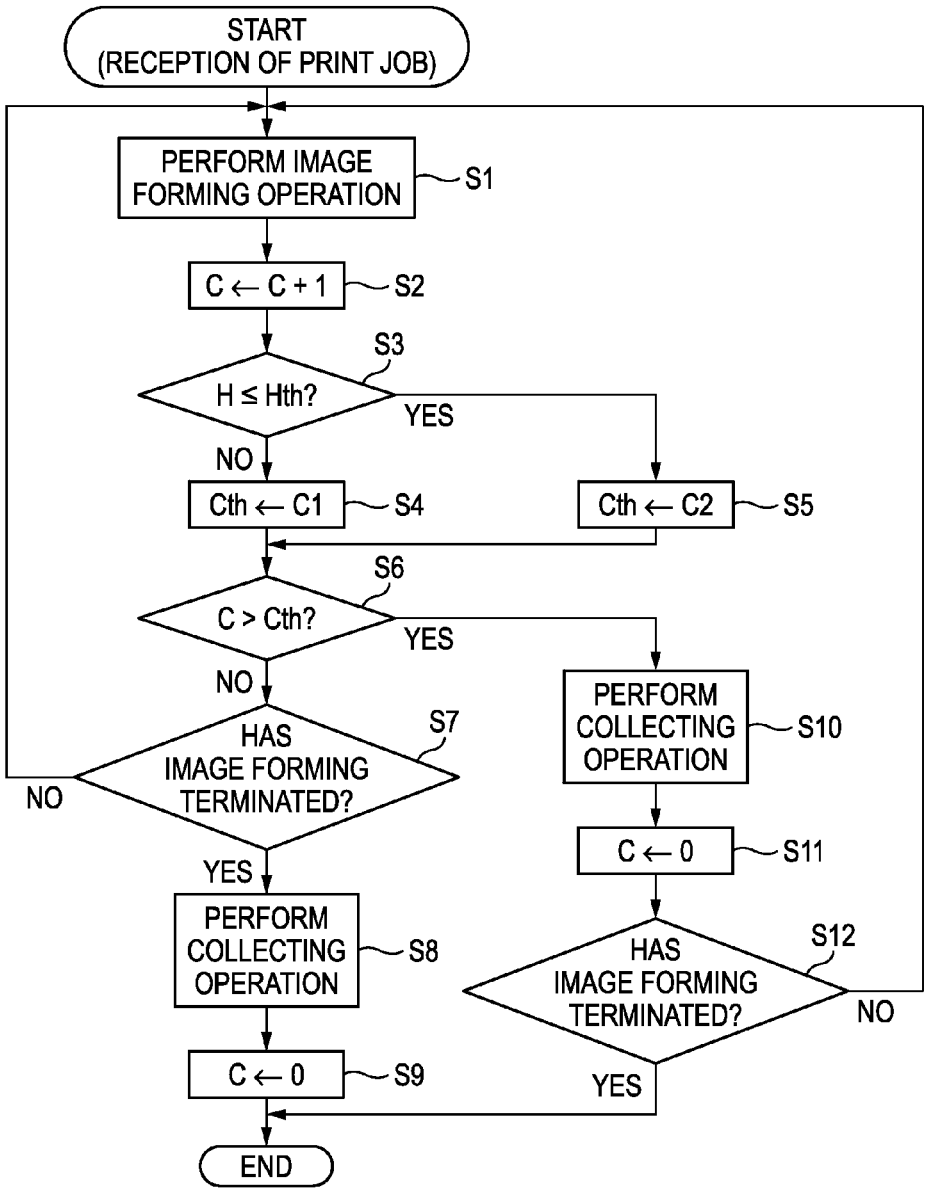
FIG. 5 is a flow chart illustrating an operation of the color printer.

As shown in FIG. 5, when a print job is input (START), in STEP S1, the color printer 1 performs the image forming operation. Next, in STEP S2, the counting unit 140 adds 1 to the count value C (C←C+1).

In the progress of the image forming operation, the first bias (e.g., negative bias) is applied to the holding rollers 55, whereby the holding rollers 55 attract the positive-polarity toner attached on the photosensitive drums 53, and temporarily holds the toner on their surfaces.

Next, in STEP S3, the color printer 1 determines whether the humidity H in the main body casing 10 is equal to or lower than predetermined humidity Hth. In a case of determining that the humidity H exceeds the predetermined humidity Hth (No in STEP S3), in STEP S4, the color printer 1 substitutes a first threshold value C1 for a threshold value Cth of the count value C. On the other hand, in a case of determining that the humidity H in the main body casing 10 is equal to or lower than the predetermined humidity Hth (Yes in STEP S3), in STEP S5, the color printer 1 substitutes a second threshold value C2 (<C1) for the threshold value Cth of the count value C.

In a case where the input print job is a print job for forming images on sheets S equal to or less than the threshold value Cth of the count value C, for example, a print job for forming an image on one sheet S, the count value C does not exceed the threshold value Cth (NO in STEP S6). Thus, in STEP S7, the color printer 1 determines whether formation of all of images, which are image formation targets, included in the input print job has terminated (e.g., the image forming has terminated).

In a case where the input print job is a print job for forming an image on one sheet S, naturally, the image forming terminates (Yes in STEP S7). Thus, in STEP S8, the color printer 1 performs the collecting operation. Next, in STEP S9, the counting unit 140 resets the count value C (C←0).

As shown in FIG. 4, when the collecting operation starts (see the timing t11), the bias control unit 120 starts the control for applying the second bias B2 to the holding rollers 55, and the speed control unit 130 starts the control for rotating the holding rollers 55 at the second rotating speed V2.

In this case, the bias control unit 120 gradually changes the bias to be applied to the holding rollers 55 from the first bias B1 to the second bias B2 from the timing t11 to the timing t12. According to this change, the toner held on the holding rollers 55 gradually moves onto the photosensitive drums 53. Incidentally, in the present exemplary embodiment, the rotating speed of the holding rollers 55 becomes the second rotating speed V2 before the bias to be applied becomes the second bias B2.

As described above, in the color printer 1, during the collecting operation in which the toner holding power of the holding rollers 55 decreases (e.g., when the second bias B2 is being applied to the holding rollers 55), the holding rollers 55 are rotated at the low speed (e.g., the second rotating speed V2). Therefore, it is possible to reduce a centrifugal force acting on the toner. As a result, it is possible to suppress the scattering of the attached matter around the holding rollers 55, and thus it is possible to suppress a reduction in the image quality and pollution of the inside of the color printer.

Further, the color printer 1 gradually changes the bias to be applied to the holding rollers 55 from the first bias B1 to the second bias B2, whereby it is possible to gradually reduce the toner holding power of the holding rollers 55. Therefore, it is possible to more certainly suppress the scattering of the toner in the early stage of the collecting operation in which the bias to be applied to the holding rollers 55 is switched.

After the collecting operation starts (e.g., after the control for rotating the holding rollers 55 at the second rotating speed V2 starts at the timing t11), for the first period T1, the speed control unit 130 rotates the holding rollers 55 at the second rotating speed V2. After the first period T1 elapses (see the timing t13), the speed control unit 130 starts the control for rotating the holding rollers 55 at the first rotating speed V1.

Therefore, in the present exemplary embodiment, during the collecting operation in which the second bias B2 is applied, in the early stage, the holding rollers 55 rotate at the low speed, and thereafter, the holding rollers 55 rotate at a high speed.

Here, it is considered that in the early stage of the collecting operation, more toner is attached onto the holding rollers 55 and the toner becomes likely to be scattered. For this reason, in the color printer 1, in the early stage of the collecting operation, the holding rollers 55 are rotated at the low speed, whereby it is possible to effectively suppress the scattering of the toner. Further, in the color printer 1, after the first period T1 elapses, that is, in a stage in which it is considered that the amount of toner on the holding rollers 55 is less and the toner is unlike to be scattered, the holding rollers 55 are rotated at the high speed, whereby it is possible to reduce the time required for the collecting operation while suppressing the scattering of the toner.

Incidentally, in the present exemplary embodiment, the timing when the control for applying the second bias B2 to the holding rollers 55 starts is the same as the timing when the control for rotating the holding rollers 55 at the second rotating speed V2 starts. Therefore, it is possible to reduce time required for the collecting operation, as compared to a case where those timings are deviated from each other. For the above-described reasons, in the color printer 1, it is possible to reduce the time required for the next image forming operation to become possible.

When the collecting operation terminates, the bias control unit 120 stops application of the bias to the holding rollers 55, and the speed control unit 130 starts control for stopping the holding rollers 55 (see the timing t14). Then, when the holding rollers 55 stop, as shown in FIG. 5, the color printer 1 terminates the operation (END).

On the other hand, in a case where the input print job is, for example, a print job for forming images on two sheets S, in a stage in which image forming on the first sheet has terminated, in STEP S7, it is determined that image forming has not terminated (No in STEP S7). In this case, the color printer 1 proceeds to STEP S1 in which the color printer 1 performs the image forming operation on the second sheet. Then, the color printer 1 performs the STEP S2 and the subsequent processes.

Incidentally, as shown by bold broken lines in FIG. 4, in a case of restarting the image forming operation after the collecting operation, the speed control unit 130 continues to rotate the holding rollers 55 at the first rotating speed V1, and the bias control unit 120 changes the bias to be applied to the holding rollers 55 from the second bias B2 to the first bias B1 (see the timing t15).

In a case where the input print job is a print job for forming images on sheets S more than the threshold value Cth of the count value C, if the count value C actually exceeds the threshold value Cth in STEP S6 of FIG. 5 (Yes in STEP S6), in STEP S10, the color printer 1 performs the collecting operation. Next, in STEP S11, the counting unit 140 resets the count value C.

As described above, the collecting operation is configured to be performed in the case where the count value C of the counting unit 140 exceeds the threshold value Cth. Therefore, it is possible to reduce time required for forming images on all sheets S, as compared to a case of performing the collecting operation whenever image forming on each sheet S terminates.

Incidentally, in the present exemplary embodiment, in the case where the humidity H in the main body casing 10 is equal to or lower than the predetermined humidity Hth, the collecting operation is performed earlier than in a case where the count value C exceeds the second threshold value C2 smaller than the first threshold value C1, that is, a case where the humidity H in the main body casing 10 exceeds the predetermined humidity Hth.

At low humidity, since the resistance value of the sheet S is large, more non-transferred toner may be attached onto the photosensitive drums 53, and more toner may be held on the holding rollers 55 in a short time. For this reason, in the case where the humidity is low, the collecting operation is performed early. Therefore, in the color printer 1, it is possible to effectively suppress the scattering of the toner.

When the collecting operation of STEP S10 terminates, in STEP S12, the color printer 1 determines whether the image forming has terminated. In a case where the image forming has not terminated (No in STEP S12), the color printer 1 restarts the image forming operation. On the other hand, in a case where the image forming has terminated (Yes in STEP S12), the color printer 1 terminates the operation (END).

Second Exemplary Embodiment

Now, a second exemplary embodiment of the present invention will be described. In the following description, components identical to those of the above-described exemplary embodiment will be denoted by the same reference symbols, and the description thereof will be omitted. Further, a color printer 1 of the present exemplary embodiment has the same configuration as the color printer 1 of the first exemplary embodiment (see FIGS. 1 to 3).

The bias control unit 120 of the first exemplary embodiment is configured to start the control for applying the second bias B2 to the holding rollers 55 at the same time as the timing when the control for rotating the holding rollers 55 at the second rotating speed V2 (see the timing t11 of FIG. 4). Further, the bias control unit 120 of the first exemplary embodiment is configured to gradually change the bias to be applied to the holding rollers 55 from the first bias B1 to the second bias B2 (see from the timing t11 to the timing t12 in FIG. 4).

Figure 6:
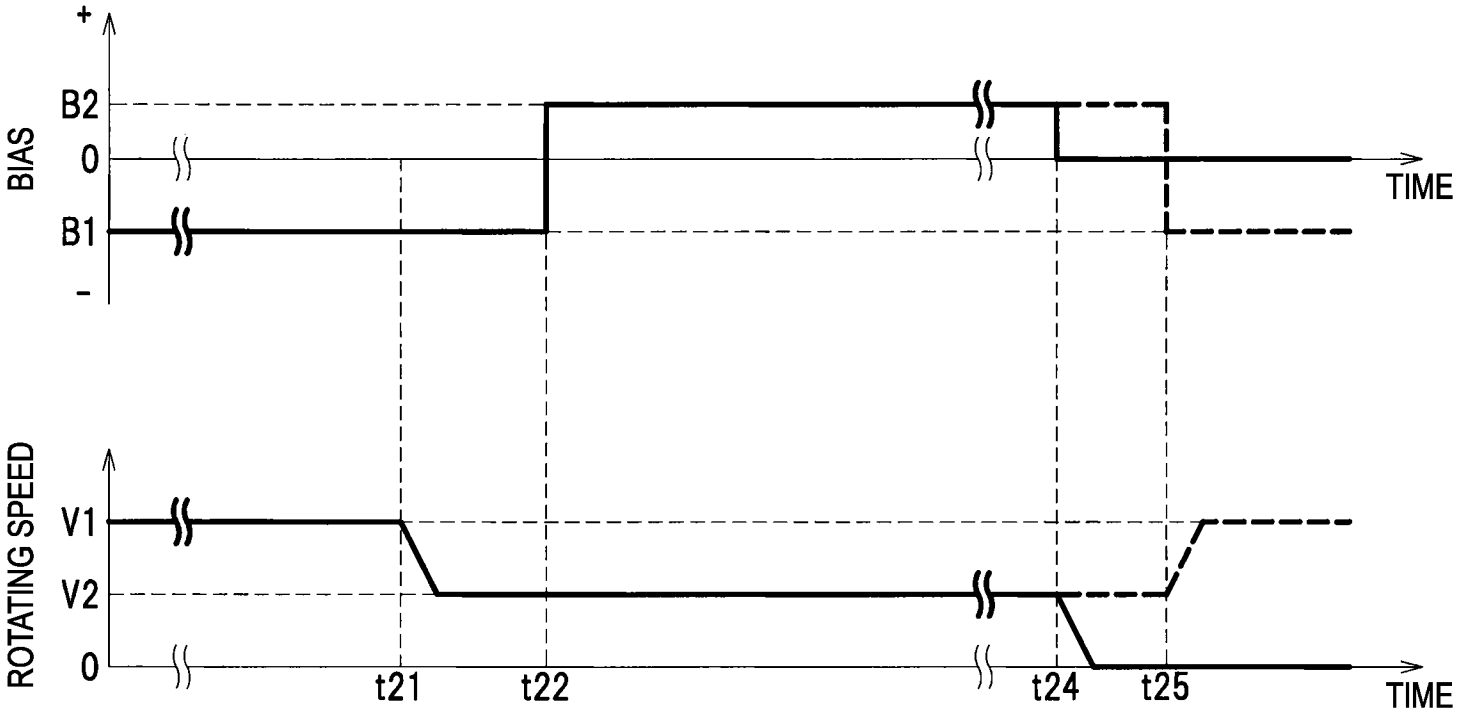
FIG. 6 is a timing chart illustrating a bias to be applied to the holding rollers and the rotating speed of the holding rollers according to a second exemplary embodiment.

As shown in FIG. 6, in the present exemplary embodiment, the bias control unit 120 is configured to apply the first bias B1 to the holding rollers 55 during the image forming operation, and to apply the second bias B2 to the holding rollers 55 during the collecting operation (in the progress of the collecting operation) (see from a timing t21 to a timing t24). The bias control unit 120 of the present exemplary embodiment is configured to start the control for applying the second bias B2 at a timing (see a timing t22) after the speed control unit 130 changes the rotating speed of the holding rollers 55 to the second rotating speed V2.

Further, the bias control unit 120 of the present exemplary embodiment is configured to rapidly change the bias value in the case of changing the bias to be applied to the holding rollers 55 from the first bias B1 to the second bias B2 and from the second bias B2 to the first bias B1 (see timings t22 and t25).

As described above, after the timing when the speed control unit 130 changes (e.g., the timing when the speed control unit 130 starts the control for changing) the rotating speed of the holding rollers 55 to the second rotating speed V2 (see the timing t21), the second bias B2 is applied. Therefore, it is possible to reduce the toner holding power of the holding rollers 55 after the centrifugal force acting on the toner on the holding rollers 55. According thereto, it is possible to further suppress the scattering of the toner.

Further, at the timing when the second bias B2 is applied (see the timing t22), since the holding rollers 55 rotates at the low speed, the centrifugal force acting on the toner is small. For this reason, even if the bias to be applied to the holding rollers 55 is rapidly changed, it is possible to suppress the scattering of the toner. Therefore, in the present exemplary embodiment, it is possible to reduce the time required for the collecting operation, as compares to a case of using a configuration in which the bias to be applied to the holding rollers 55 is gradually changed.

Third Exemplary Embodiment

Now, a third exemplary embodiment of the present exemplary embodiment will be described. In the following description, each component (including components not shown) is provided basically in the same way as a component with the same name in the color printer 1 of the first exemplary embodiment.

In the above-described exemplary embodiments, the holding rollers 55 are provided to be able to hold toner attached on the surfaces of the photosensitive drums 53. In the present exemplary embodiment, a holding roller is provided to be able to hold toner (e.g., attached matter) attached on the surface of the endless belt.

Figure 7:
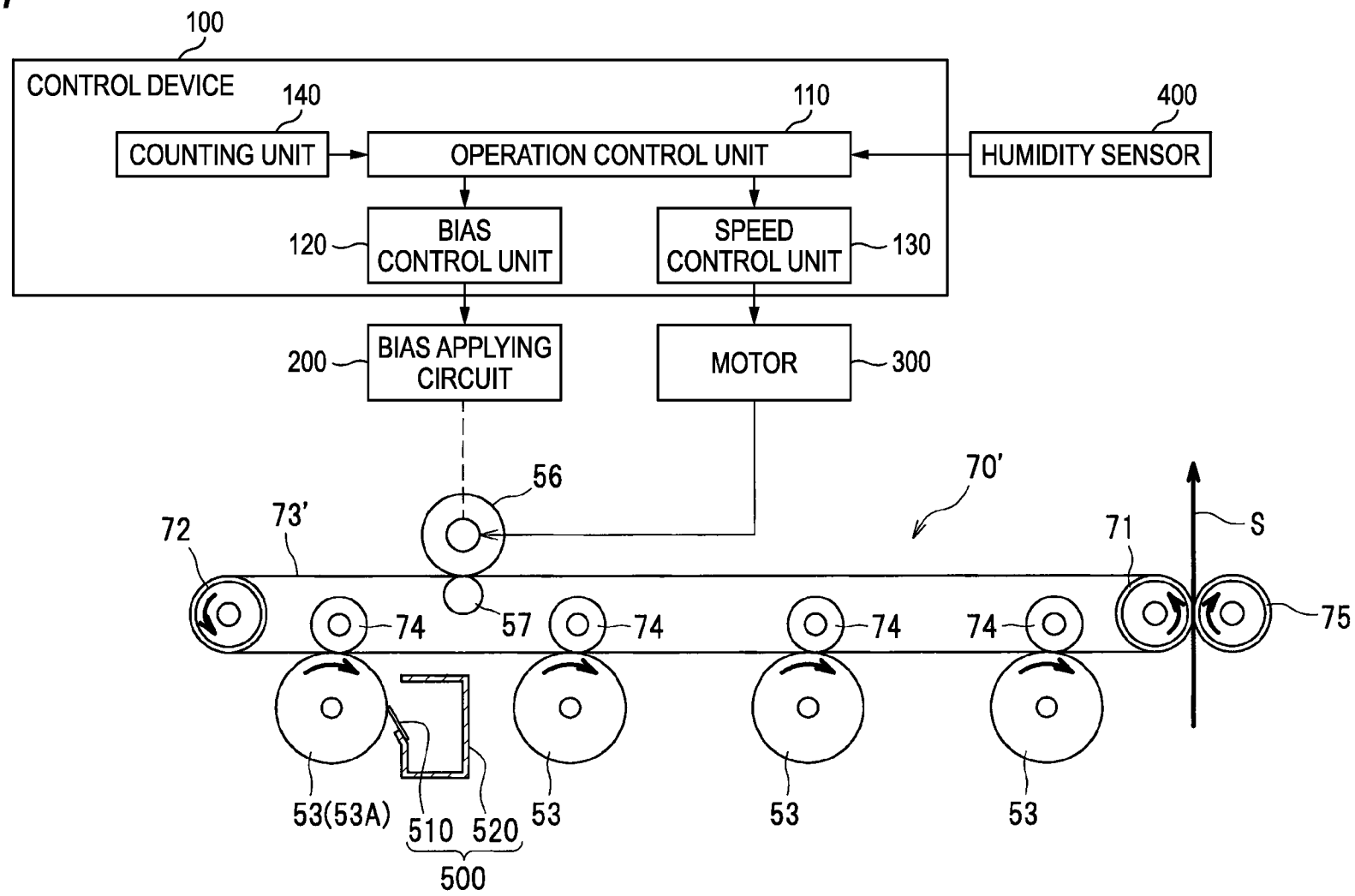
FIG. 7 is a view illustrating a schematic configuration of an image forming apparatus according to a third exemplary embodiment.

As shown in FIG. 7, a color printer of the present exemplary embodiment includes a sheet feeding unit, an image forming unit, a control device 100, a bias applying unit 200, a motor 300, a humidity sensor 400, a drum cleaning unit 500 which is another example of the collecting unit, a holding roller 56, and a backup roller 57, which are contained in a main body casing.

Also, the image forming unit includes four LED units, four process units including photosensitive drums 53, a transfer unit 70', and a fixing unit. The process units of the present exemplary embodiment do not include the holding rollers 55 of the above-described exemplary embodiments.

The transfer unit 70' includes a drive roller 71, a driven roller 72, an intermediate transfer belt 73' (one example of an image carrier) which is another example of the endless belt, four primary transfer rollers 74, and a secondary transfer roller 75. The primary transfer rollers 74 are disposed to face the photosensitive drums 53 with the intermediate transfer belt 73' interposed therebetween, and the secondary transfer roller 75 is disposed to face the drive roller 71 with the intermediate transfer belt 73' interposed therebetween.

In this color printer, during the image forming operation, toner images of individual colors formed on the photosensitive drums 53 are sequentially transferred on the intermediate transfer belt 73' such that the toner images overlap one another. Then, when sheet S sent from the sheet feeding unit is conveyed between the intermediate transfer belt 73' and the secondary transfer roller 75, the toner image on the intermediate transfer belt 73' is transferred onto the sheet S. The sheet S having the toner image transferred thereon passes through the fixing unit, and is loaded on a discharge tray by a discharging roller.

The holding roller 56 can hold toner attached on the surface of the intermediate transfer belt 73'. The holding roller 56 includes a conductive rotary shaft and a conductive roller body covering the circumference of the rotary shaft. The holding roller 56 is disposed to face the backup roller 57 with the intermediate transfer belt 73' interposed therebetween.

When a negative bias (e.g., the first bias which has the opposite polarity to the charge polarity of the toner) is applied, the holding roller 56 attracts non-transferred toner on the intermediate transfer belt 73' between the holding roller 56 and the backup roller 57 and temporarily holds the toner on its surface. When a positive bias higher than the surface potential of the intermediate transfer belt 73' (e.g., the second bias which has the same polarity as the charge polarity of the toner) is applied, the holding roller 56 releases the held toner such that the toner is moved onto the intermediate transfer belt 73'.

In the present exemplary embodiment, the holding roller 56 is configured to be subjected to torque input from the motor 300 through a driving-force transmission mechanism composed of a train of gears (not shown). Alternatively, in the present invention, the holding roller 56 may be configured to be subject to torque input, for example, from the drive roller 71 or the driven roller 72 of the transfer unit 70' through a train of gears.

The drum cleaning unit 500 is provided close to a photosensitive drum 53 (53A) positioned on the most upstream side in the conveyance direction of the intermediate transfer belt 73'. The drum cleaning unit 500 includes a blade 510 and a toner retaining unit 520. The blade 510 is a member which comes into slide contact with the photosensitive drum 53A and collects toner attached on the surfaces of the photosensitive drum 53. The toner retaining unit 520 is a container-like member in which the toner collected (scraped) by the blades 510 are retained.

In this color printer, during the collecting operation, the toner held on the holding roller 56 is first moved onto the intermediate transfer belt 73', and then the toner on the intermediate transfer belt 73' is moved onto the photosensitive drum 53A. Thereafter, according to the rotation of the photosensitive drum 53A, the toner attached on the surface of the photosensitive drum 53A is scraped by the blade 510, and is retained in the toner retaining unit 520.

Incidentally, with respect to control on the bias to be applied to the holding roller 56 and control on the rotating speed of the holding roller 56, the control method of the above-described first or second exemplary embodiment can be used. Therefore, in the present exemplary embodiment, the bias control and the speed control will not be described in detail.

Even in the color printer of the present exemplary embodiment configured as described above, when the second bias is being applied such that the toner holding power of the holding roller 56 is reduced, the holding roller 56 is rotated at a low speed. Therefore, it is possible to suppress the scattering of the toner around the holding roller 56. As a result, it becomes possible to suppress a reduction in the image quality and pollution of the inside of the color printer.

Fourth Exemplary Embodiment

Now, a fourth exemplary embodiment of the present invention will be described.

In the above-described exemplary embodiments, the holding rollers 55 and 56 positively collect toner on the photosensitive drums 53 and the intermediate transfer belt 73'. However, the holding roller of the present invention is not limited thereto.

Figure 8A:
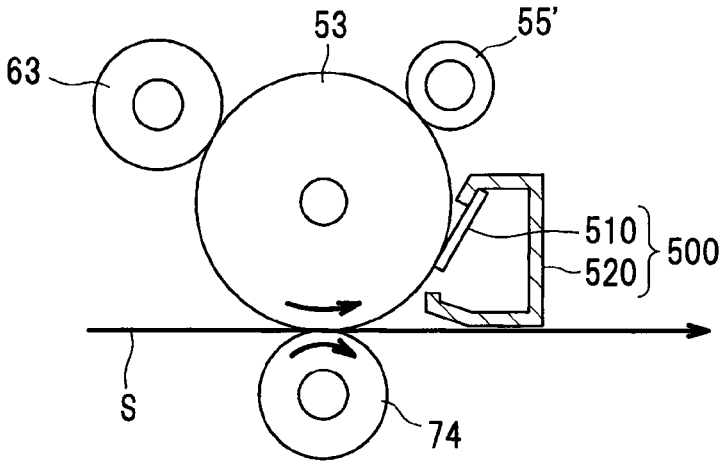
FIGS. 8A and 8B are views illustrating schematic configurations of image forming apparatuses according to a fourth exemplary embodiment and a modification of the fourth exemplary embodiment, respectively.

As shown in FIG. 8A, an image forming apparatus of the present exemplary embodiment is a printer which forms only monochrome images and includes one unit for exposing the surface of a photosensitive drum 53, one process unit (e.g., photosensitive drum 53), and one transfer roller 74. Further, this printer includes a charging roller 55' which is another example of the holding roller, and a drum cleaning unit 500.

The charging roller 55' is configured to uniformly and positively charge the surface of the photosensitive drum 53 before exposing. The charging roller 55' is subjected to application of a positive bias (e.g., the first bias which has the same polarity as the charge polarity of the toner) higher than the surface potential of the photosensitive drum 53 during an image forming operation.

In this printer, during the image forming operation, when a sheet S fed from a sheet feeding unit is conveyed between the photosensitive drum 53 and the transfer roller 74, a toner image formed on the photosensitive drum 53 is transferred onto the sheet S. At this time, since a negative bias is applied to the transfer roller 74, paper dust on the sheet S conveyed between the photosensitive drum 53 and the transfer roller 74 is negatively charged, and a portion of the paper dust is attached to the surface of the photosensitive drum 53.

Most of the attached matter, that is, the paper dust attached on the surface of the photosensitive drum 53 is collected by the drum cleaning unit 500. However, some of the paper dust reaches a portion facing the charging roller 55' and is attracted by the charging roller 55' subjected to application of a positive bias. Thus, some of the paper dust is attached (held) on the charging roller 55'.

For this reason, in the present exemplary embodiment, during a collecting operation, a negative bias (e.g., the second bias which has the opposite polarity to the charge polarity of the toner) is applied to the charging roller 55', so as to move the paper dust onto the photosensitive drum 53. Further, in the present exemplary embodiment, a bias is not applied to the transfer roller 74 during the collecting operation. Therefore, the paper dust reattached on the photosensitive drum 53 is collected by the drum cleaning unit 500.

Figure 8B:
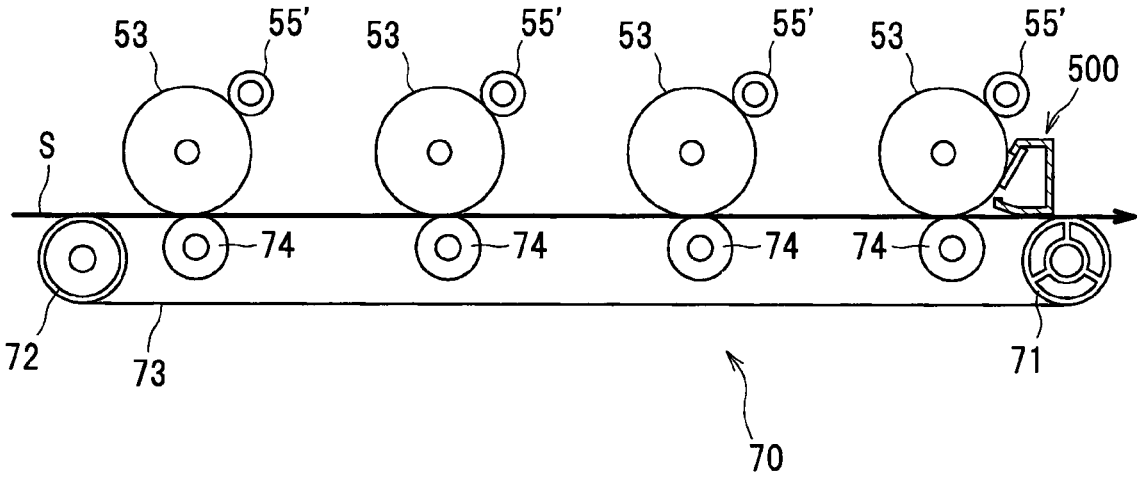

Incidentally, the configuration using the charging roller 55' as the holding roller can be applied even to a color printer having a plurality of photosensitive drums 53 as shown in FIG. 8B. In this case, the drum cleaning unit 500 may be provided only for a photosensitive drum 53 positioned on the most downstream side in the conveyance direction of a conveyance belt 73, or may be provided for each photosensitive drum 53 although not shown. In the configuration as shown in FIG. 8B in order to collect paper dust by the drum cleaning unit 500, an appropriate bias is applied to each transfer roller 74.

Although the exemplary embodiments of the present invention have been described above, the present invention is not limited to the above-described exemplary embodiments. The specific configurations can be appropriately modified within the scope of the present invention.

Figure 9:
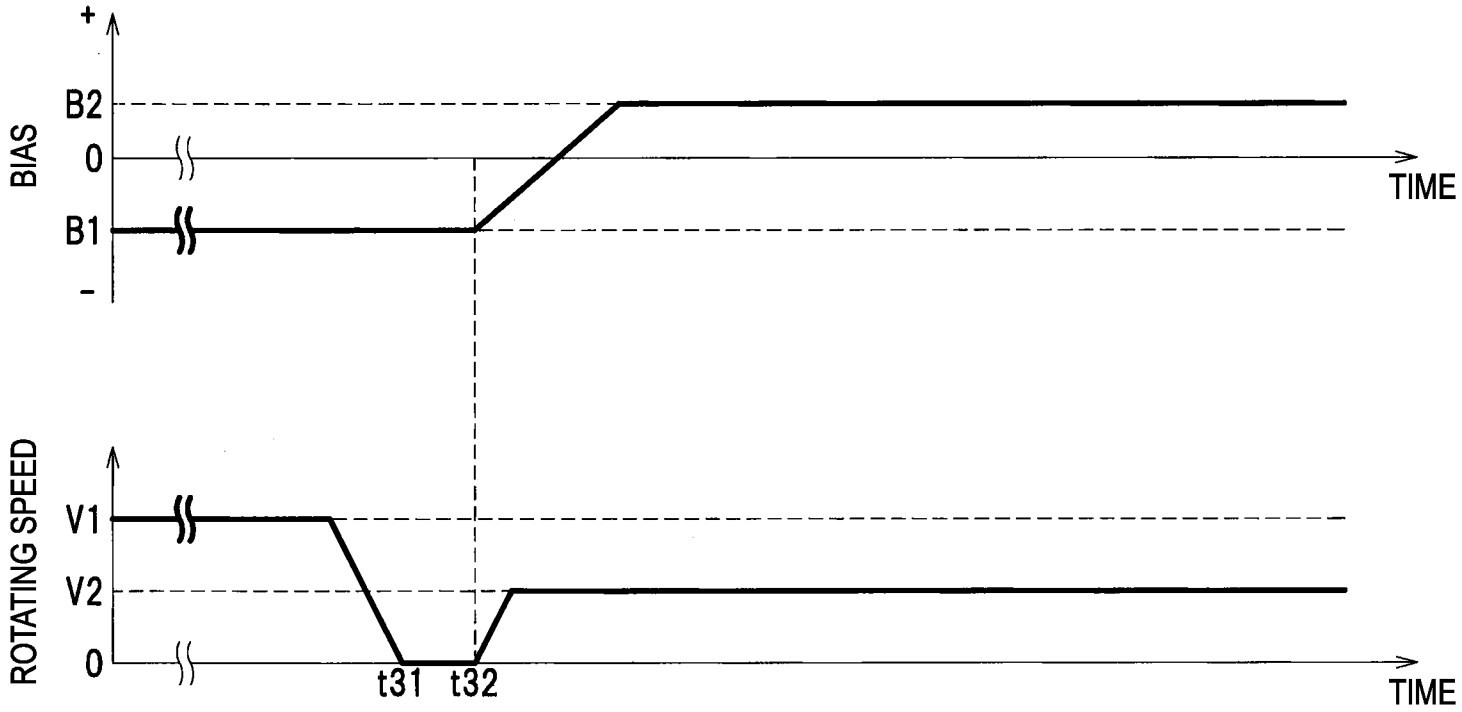
FIG. 9 is a timing chart illustrating a bias to be applied to the holding rollers and the rotating speed of the holding rollers according to a modification.

In the above-described exemplary embodiments, as shown at the timing t11 in FIG. 4 or at the timing t21 in FIG. 6, when the collecting operation starts, the rotating speed of the holding rollers 55 is changed from the first rotating speed V1 directly to the second rotating speed V2. However, the present invention is not limited thereto. For example, as shown in FIG. 9, before the collecting operation starts (see before a timing t32), the holding rollers rotating at the first rotating speed V1 may be temporarily stopped (see a timing t31), and thereafter, the holding rollers are rotated at the second rotating speed V2 (see after the timing t32).

In the above-described exemplary embodiments, in a case where formation of all of images which are image formation targets included in an input print job terminates, and in a case where the count value of the counting unit 140 exceeds the threshold value, the collecting operation is performed. However, the present invention is not limited thereto. For example, the image forming apparatus may be configured to perform the collecting operation only in the case where the count value of the counting unit 140 exceeds the threshold value, or may be configured to perform the collecting operation whenever image forming on each sheet S terminates.

In the above-described exemplary embodiments, as shown in FIG. 4 (see from the timing t11 to the timing t13), a period (e.g., the first period T1) from when the control for applying the second bias B2 to the holding rollers 55 starts in the progress of the collecting operation to when the holding rollers 55 are rotated at the second rotating speed V2 is the same as a period (e.g., the second period) from when the collecting operation starts in the progress of the collecting operation to when the rotating speed of the holding rollers 55 is changed from the second rotating speed V2 to the first rotating speed V1. However, the present invention is not limited thereto. For example, the first period and the second period may be different from each other.

In the above-described exemplary embodiments, the counting unit 140 is configured to count the number of sheets S (e.g., recording sheets) subjected to image forming on the basis of information on the number of images which are image forming targets included in a print job. However, the present invention is not limited thereto. For example, the counting unit may be configured to count the number of recording sheets on the basis of a detection result of a sensor which is provided in the image forming apparatus and is for detecting passage of recording sheets.

In the above-described exemplary embodiments, the counting unit for counting the number of sheets S (e.g., recording sheets) is provided, and in the case where the count value of the counting unit 140 exceeds the threshold value, the collecting operation is performed. However, the present invention is not limited thereto. For example, the image forming apparatus may include a dot counting unit for counting the number of dots of images formed on recording sheets, and perform the collecting operation in a case where a count value of the dot counting unit exceeds a threshold value.

In the above-described exemplary embodiments, the holding rollers 55 are configured to be rotated by a torque input from the photosensitive drums 53. However, the present invention is not limited thereto. For example, the holding rollers may be rotated by a torque input from a motor different from the motor for rotating the photosensitive drums. Also, the rotating speed of the holding rollers is changed according to a change in the rotating speed of the motor. However, the present invention is not limited thereto. For example, the rotating speed of the holding rollers may be changed by a speed changing mechanism composed of a plurality of gears.

In the above-described exemplary embodiments, in a case of changing the bias to be applied to the holding rollers 55, the bias value is gradually changed (see from the timing t11 to the timing t12 in FIG. 4), or is rapidly changed (see the timing t22 in FIG. 6). However, the present invention is not limited thereto. For example, in the case of changing the bias to be applied to the holding rollers, the bias value may be changed in a stepwise manner.

In the above-described exemplary embodiments, the configurations including the humidity sensor 400 (e.g., a humidity detecting unit) have been exemplified. However, the present invention is not limited thereto. For example, the image forming apparatus may include a detecting unit for detecting the resistance value of a recording sheet (paper), and perform the collecting operation if a detection value of the detecting unit exceeds a predetermined resistance value.

In the above-described exemplary embodiments, examples obtained by applying the present invention to the image forming apparatuses using positively charged toner (e.g., developer) have been described. However, the present invention is not limited thereto. In other words, the present invention can be applied even to image forming apparatuses using negatively charged developers. In this case, the polarities of the first bias and the second bias are opposite to those of the first exemplary embodiment (see FIG. 4).

In the above-described exemplary embodiments, as the image forming apparatus, the printers have been exemplified. However, the present invention is not limited thereto. For example, the image forming apparatus may be a copy machine, a multi-function apparatus, or the like having a document reading unit such as a flatbed scanner.

In the above-described exemplary embodiments, as the recording sheets, the sheets S such as so-called plain paper have been exemplified. However, the present invention is not limited thereto. For example, OHP sheets and others can be used.

Example

Now, an example from which it was confirmed that if the rotating speed of the holding rollers is reduced, the amount of scattering of toner decreases will be described.

In this example, image forming (beta printing of a constant concentration) was consecutively performed on 30 sheets using a printer HL-3040CN (made by Brother Industries, Ltd.) having the same configuration as that of the first exemplary embodiment, and the amount of toner attached on a wall (see a bold line portion of a wall 52A in FIG. 2) in the vicinity of a holding roller was measured.

Specifically, the toner attached to the inner surface of the wall in the vicinity of the holding roller was collected with mending tape, the mending tape was attached to a sheet, and the transmission density of the mending-tape attachment portion (the mending tape, the scattered toner, and the sheet) was measured with a Macbeth TD 904 Transmission Densitometer (made by Macbeth Co.). Transmission density values shown in FIG. 10 are values obtained by subtracting the transmission densities of the mending tape and the sheet from the measured values.

A comparative example is a transmission density when a process unit including the holding roller (having the outside diameter of 9 mm) was driven at 16 ppm (full speed). In a case of the comparative example, the speed of the holding rollers becomes about 337 rpm. Also, the example is a transmission density when a process unit including the holding roller (having the outside diameter of 9 mm) was driven at 8 ppm (half speed). In a case of the example, the speed of the holding rollers becomes about 169 rpm. Here, 'ppm' means the number of sheets subjected to printing per one minute (page per minute), and 'rpm' means the number of revolutions per one minute (revolution per minute).

Figure 10:
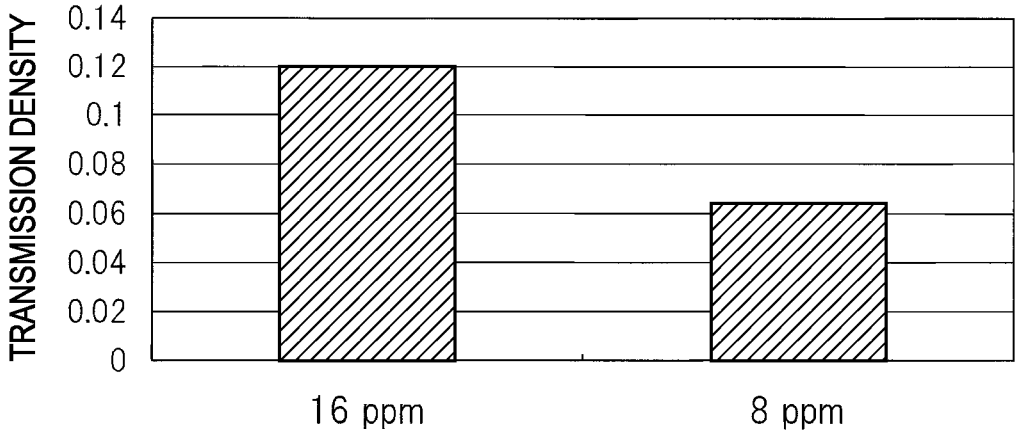
FIG. 10 is a graph illustrating the relation between the rotating speed of the holding rollers and an amount of scattering of toner.

As shown in FIG. 10, in the comparative example (16 ppm), the transmission density was about 0.12; whereas in the example (8 ppm), the transmission density was about 0.06. In the above-described way, it was confirmed that if the rotating speed of the holding rollers is reduced, the amount of scattering of toner decreases. Therefore, it can be said that when a bias is being applied to the holding rollers such that toner (attached matter) held on the holding rollers is moved onto the photosensitive drums, if the holding rollers are rotated at a low rotating speed, it is possible to suppress the scattering of the attached matter around the holding rollers.

What is claimed is:

1. An image forming apparatus comprising:

a photosensitive drum;

a holding roller configured to hold matter attached on a surface of the photosensitive drum;

a bias control unit configured to control a bias to be applied to the holding roller; and a speed control unit configured to control a rotating speed of the holding roller, wherein the image forming apparatus is configured to perform:

an image forming operation for forming an image on a recording sheet; and a collecting operation for moving the attached matter held on the holding roller onto the photosensitive drum and collecting the attached matter through the photosensitive drum by a collecting unit, wherein the bias control unit is configured to:

during the image forming operation, apply a first bias for moving the matter attached on the surface of the photosensitive drum onto the holding roller; and during the collecting operation, apply a second bias for moving the attached matter held on the holding roller onto the photosensitive drum, and wherein the speed control unit is configured to:

control the holding roller to rotate at a first rotating speed during the image forming operation; and in a progress of the collecting operation, control the holding roller to rotate at a second rotating speed, which is slower than the first rotating speed, at least for a first period after the bias control unit applies the second bias to the holding roller.

2. The image forming apparatus according to claim 1, wherein the bias control unit is configured to apply the second bias after the speed control unit changes the rotating speed of the holding roller from the first rotating speed to the second rotating speed.

3. The image forming apparatus according to claim 1, wherein a timing when the bias control unit starts control for applying the second bias to the holding roller is the same as a timing when the speed control unit starts control for rotating the holding roller at the second rotating speed.

4. The image forming apparatus according to claim 1, wherein the bias control unit is configured to gradually change a value of the bias when changing the bias to be applied to the holding roller from the first bias to the second bias.

5. The image forming apparatus according to claim 1, wherein the image forming apparatus is configured to input a torque from the photosensitive drum to the holding roller.

6. The image forming apparatus according to claim 1, wherein in the progress of the collecting operation, the speed control unit is configured to control the holding roller to rotate at the second rotating speed for a second period from when the collecting operation starts, and thereafter, control the holding roller to rotate at the first rotating speed.

7. The image forming apparatus according to claim 1, further comprising:

a counting unit configured to count a number of recording sheets subjected to the image forming operation, wherein the image forming apparatus is configured to perform the collecting operation in a case where a count value of the counting unit exceeds a first threshold value.

8. The image forming apparatus according to claim 7, further comprising:

a humidity detecting unit configured to detect humidity in the image forming apparatus, wherein in a case where a detection value of the humidity detecting unit is equal to or lower than predetermined humidity, the image forming apparatus is configured to perform the collecting operation when the count value of the counting unit exceeds a second threshold value that is smaller than the first threshold value.

9. The image forming apparatus according to claim 1, further comprising:

an endless belt that is disposed to face the photosensitive drum; and a belt cleaning unit configured to function as the collecting unit for collecting matter attached on the surface of the belt, wherein in the collecting operation, the belt cleaning unit is configured to collect the attached matter held on the holding roller through the photosensitive drum and the belt.

10. The image forming apparatus according to claim 1, wherein the collecting unit comprises a blade configured to come into slide contact with the photosensitive drum and to collect the matter attached on the surface of the photosensitive drum.

11. An image forming apparatus comprising:

a photosensitive drum;

an endless belt that is disposed to face the photosensitive drum;

a holding roller configured to hold matter attached on a surface of the belt;

a bias control unit configured to control a bias to be applied to the holding roller; and a speed control unit configured to control a rotating speed of the holding roller, wherein the image forming apparatus is configured to perform:

an image forming operation for forming an image on a recording sheet; and a collecting operation for moving the attached matter held on the holding roller onto the belt and collecting the attached matter through the belt by a collecting unit, wherein the bias control unit is configured to:

during the image forming operation, apply a first bias for moving the matter attached on the surface of the belt onto the holding roller; and during the collecting operation, apply a second bias for moving the attached matter held on the holding roller onto the belt, and wherein the speed control unit is configured to:

control the holding roller to rotate at a first rotating speed during the image forming operation; and in a progress of the collecting operation, control the holding roller to rotate at a second rotating speed, which is slower than the first rotating speed, at least for a first period after the bias control unit applies the second bias to the holding roller.

12. The image forming apparatus according to claim 11, wherein the bias control unit is configured to apply the second bias after the speed control unit changes the rotating speed of the holding roller from the first rotating speed to the second rotating speed.

13. The image forming apparatus according to claim 11, wherein a timing when the bias control unit starts control for applying the second bias to the holding roller is the same as a timing when the speed control unit starts control for rotating the holding roller at the second rotating speed.

14. The image forming apparatus according to claim 11, wherein the bias control unit is configured to gradually change a value of the bias when changing the bias to be applied to the holding roller from the first bias to the second bias.

15. The image forming apparatus according to claim 11, wherein in the progress of the collecting operation, the speed control unit is configured to control the holding roller to rotate at the second rotating speed for a second period from when the collecting operation starts, and thereafter, control the holding roller to rotate at the first rotating speed.

16. The image forming apparatus according to claim 11, further comprising:

a counting unit configured to count a number of recording sheets subjected to the image forming operation, wherein the image forming apparatus is configured to perform the collecting operation in a case where a count value of the counting unit exceeds a first threshold value.

17. The image forming apparatus according to claim 16, further comprising:

a humidity detecting unit configured to detect humidity in the image forming apparatus, wherein in a case where a detection value of the humidity detecting unit is equal to or lower than predetermined humidity, the image forming apparatus is configured to perform the collecting operation when the count value of the counting unit exceeds a second threshold value that is smaller than the first threshold value.

18. The image forming apparatus according to claim 11, wherein the collecting unit comprises a blade configured to come into slide contact with the photosensitive drum and collect the matter attached on the surface of the photosensitive drum.

19. An image forming apparatus comprising:

an image carrier;

a holding roller configured to hold matter attached on a surface of the image carrier;

a collecting unit; and a control device configured to perform:

a bias control process of controlling a bias to be applied to the holding roller;

a speed control process of controlling a rotating speed of the holding roller; and an operation control process of controlling the image forming apparatus to perform:

an image forming operation for forming an image on a recording sheet; and a collecting operation for moving the attached matter held on the holding roller onto the image carrier and collecting the attached matter through the image carrier by the collecting unit, wherein the bias control process comprises:

during the image forming operation, applying a first bias for moving the matter attached on the surface of the image carrier onto the holding roller; and during the collecting operation, applying a second bias for moving the attached matter held on the holding roller onto the image carrier, and wherein the speed control process comprises:

controlling the holding roller to rotate at a first rotating speed during the image forming operation; and in a progress of the collecting operation, controlling the holding roller to rotate at a second rotating speed, which is slower than the first rotating speed, at least for a first period after the bias control process applies the second bias to the holding roller.

* * * * *